US011896192B2

(12) United States Patent
Pan

(10) Patent No.: US 11,896,192 B2
(45) Date of Patent: Feb. 13, 2024

(54) DIRT DETECTION METHOD FOR CLEANING DEVICE AND DIRT COLLECTING DEVICE

(71) Applicant: SHENZHEN JASHEN TECHNOLOGY CO., LTD., Shenzhen (CN)

(72) Inventor: Qi Pan, Shenzhen (CN)

(73) Assignee: SHENZHEN JASHEN TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/390,327

(22) Filed: Jul. 30, 2021

(65) Prior Publication Data

US 2022/0296063 A1 Sep. 22, 2022

(30) Foreign Application Priority Data

Mar. 19, 2021 (CN) ..... 202110296262.7

(51) Int. Cl.
*A47L 9/28* (2006.01)
*A47L 9/16* (2006.01)

(52) U.S. Cl.
CPC ..... *A47L 9/281* (2013.01); *A47L 9/1683* (2013.01); *A47L 9/2831* (2013.01)

(58) Field of Classification Search
CPC ..... A47L 9/281; A47L 9/1683; A47L 9/2831; G01R 31/34; B08B 13/00; G01P 3/00
See application file for complete search history.

(56) References Cited

U.S. PATENT DOCUMENTS

2021/0204780 A1* 7/2021 Pohlman ..... A47L 11/4011

* cited by examiner

*Primary Examiner* — David Redding
(74) *Attorney, Agent, or Firm* — Muncy, Geissler, Olds & Lowe, P.C.

(57) ABSTRACT

A dirt detection method includes the steps of: selecting a motor with a motor processor, and then using the motor to provide power to form a negative pressure to suck the dirt into the dirt collection device, the motor processor sending the motor's operating signal to the detection processor that has written therein a threshold range for detection, and then comparing the threshold range with the operating signal from the motor processor. The invention is based on the motor as the power source of negative pressure, and the dirt collection device has good collection effect and sealing. Based on the equipment characteristics of the motor in the negative pressure system, the degree of dirt in the dirt collection device is detected by detecting the operating signal of the motor.

5 Claims, 6 Drawing Sheets

DIRT DETECTION METHOD FOR CLEANING DEVICE AND DIRT COLLECTING DEVICE

BACKGROUND OF THE INVENTION

1. Field of the Invention

The present invention relates to cleaning device technology and more particularly, to a dirt detection method for cleaning device and a dirt collecting device.

2. Description of the Related Art

With the development of the times, various cleaning equipment used in daily life have more and more sophisticated designs and better performance.

Generally, in the process of using a drum type cleaning device, due to the contamination of the drum, the use efficiency is reduced, and the drum is inconvenient to clean due to its own structural limitation, which further affects the convenience of use.

Therefore, some drum type cleaning devices, in addition to directly cleaning the bottom surface through the drum brush, are designed with a water spray system to flush the drum brush in time, and then the sewage and solid pollutants generated after washing are sucked by the negative pressure system and collected into the dirt collection device.

Since the dirt collection device has a fixed capacity, it cannot continue to receive dirt after the dirt collection device is filled to a certain extent. Out of the overall design ideas of intelligence and electronic control, and the dirt collection bucket cannot be filled in excess, it is necessary to measure and detect the dirt in the dirt collection device to further improve the use efficiency of the drum type cleaning device.

SUMMARY OF THE INVENTION

In view of the above situation, the present invention provides a dirt detection method for cleaning device and dirt collecting device, which satisfies better use effect.

To achieve this and other objects of the present invention a dirt detection method for cleaning device comprises the steps of:

A dirt detection method for cleaning device, comprising the steps of:

S100: choosing a motor with a motor processor;

S200: enabling the motor provide power to form negative pressure and using the negative pressure to suck dirt into a dirt collection device;

S300: writing a threshold range for detection into a detection processor, and then connecting the motor processor to the detection processor so that the motor processor sends the operating signal of the motor to the detection processor; and

S400: the detection processor comparing the threshold range with the operating signal from the motor processor.

Preferably, in step S400, according to the comparison result, the detection processor sends out a control signal.

Preferably, in step S400, when the operating signal enters the threshold range, the detection processor recognizes that the dirt collection device is in a full state, and sends a corresponding control signal.

Preferably, in step S400, when the operating signal does not enter the threshold range, the detection processor recognizes that the dirt collection device is not yet full, and sends a corresponding control signal.

Preferably, the operating signal is a current signal, and the threshold range is a current value range.

Preferably, the operating signal is a speed signal, and the threshold range is a speed range.

Preferably, the motor is a brushless motor equipped with an electronic speed controller, and the motor processor is provided on the electronic speed controller.

The invention is novel in concept, reasonable in design, and easy to use. The invention is based on the need for a motor as the power source of negative pressure in the device, and at the same time, based on the negative pressure system combined with the equipment characteristics of the motor, and the dirt collection device has a good collection effect and tightness. The invention detects the degree of dirt in the dirt collection device by detecting the corresponding operating signal on the motor. The idea is clever and the applicability is better.

DETAILED DESCRIPTION OF THE INVENTION

Figure 1:
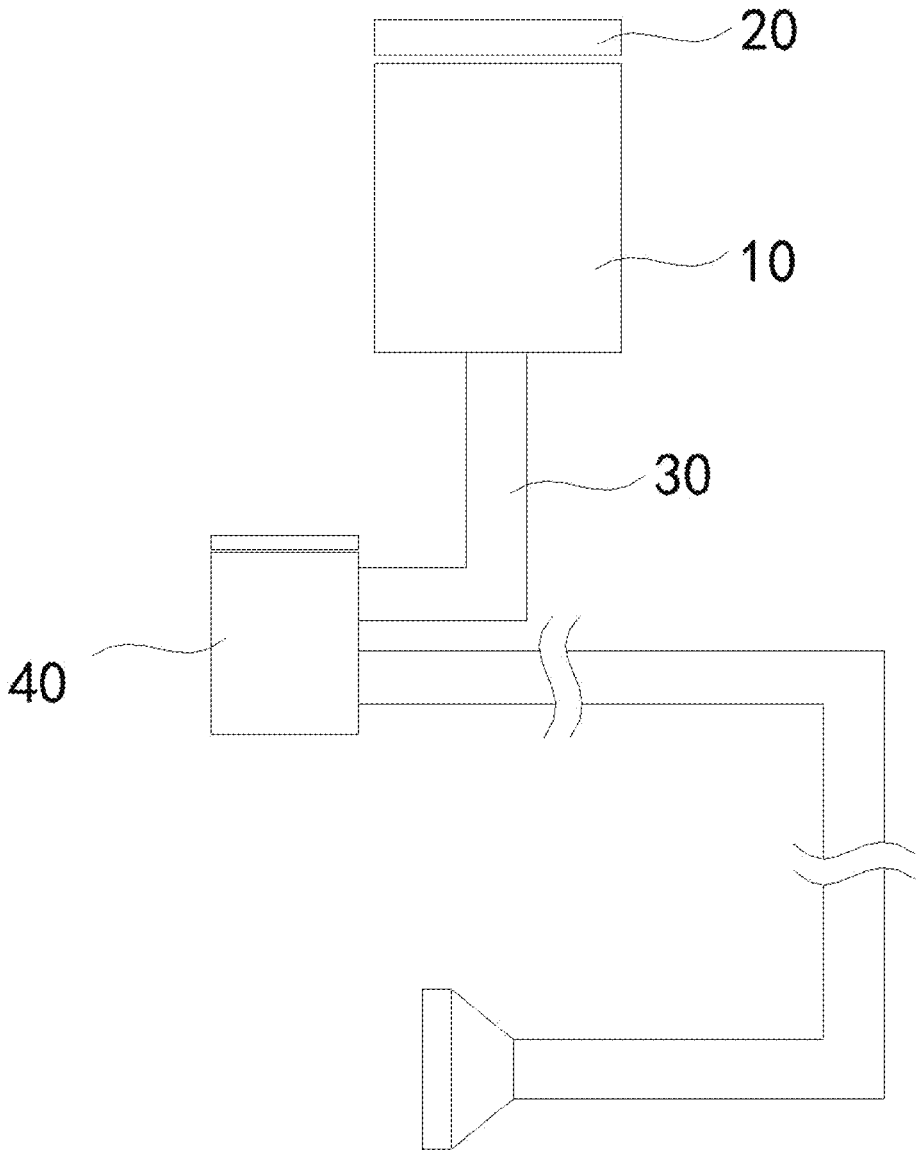
FIG. 1 is a schematic diagram of the structure of a negative pressure system of a cleaning device according to the present invention.
Figure 2:
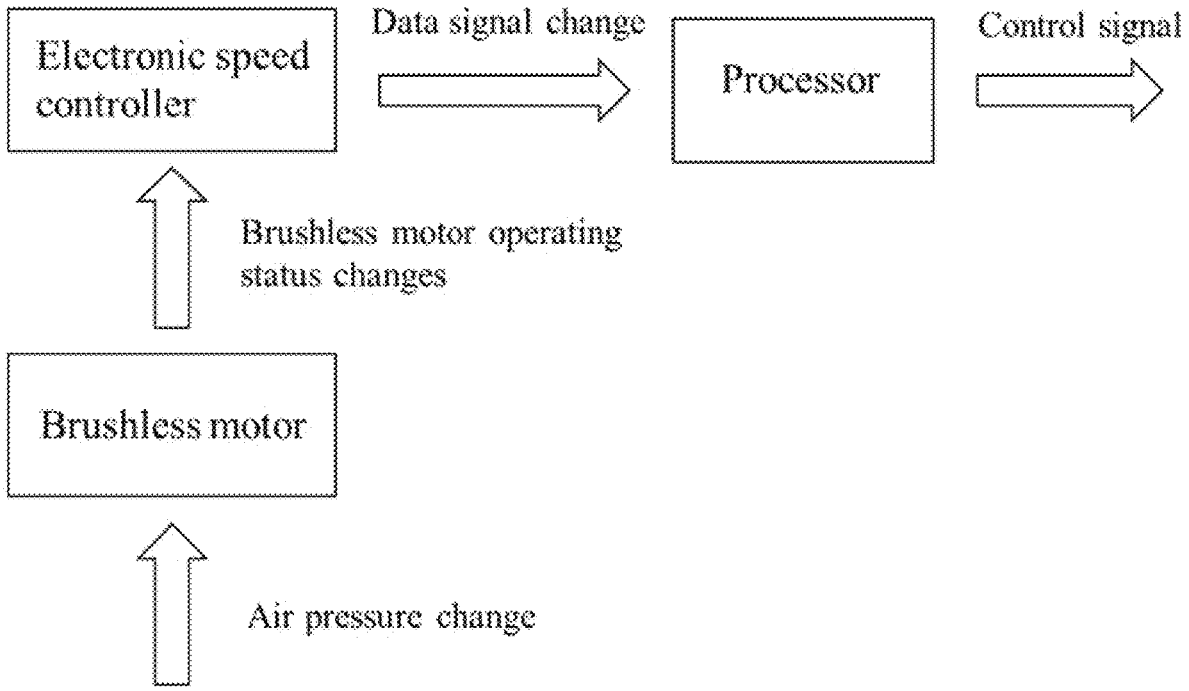
FIG. 2 is a logical block diagram of the present invention using a brushless motor.
Figure 3:
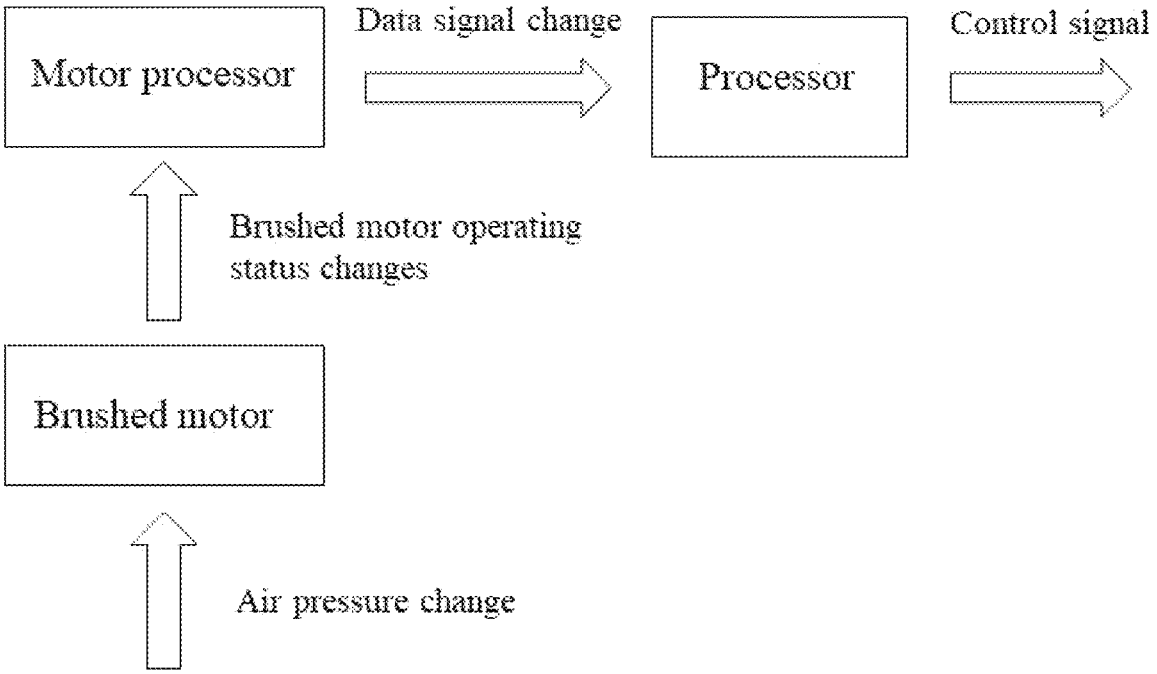
FIG. 3 is a logical block diagram of the present invention using a brushed motor.

Referring to FIGS. 1-3, in order to specifically illustrate the technical solution of the present invention, the corresponding hardware and the formed system are introduced in the specific implementation. As shown in FIG. 1, a negative pressure system for absorbing dirt is shown comprising a motor 10 for generating power. The motor 10 is provided with a special motor processor 20 for use in cooperation. Based on the working principle of the motor 10, the operating signals such as the detection current signal and the rotation speed signal of the motor 10 can be obtained by the motor processor 20. When the motor 10 is working, it generates negative pressure through a pipe system 30 and sucks the dirt into a dirt collection device 40. A relatively closed system is formed through the pipe system 30 and the dirt collection device 40. Therefore, when the dirt collection device 40 collects dirt to a certain extent, the internal air pressure of the closed dirt collection device 40 will change, and it will physically affect the motor 10, which in turn affects the operation of the motor 10 and is actually captured by the motor processor 20 as operating signals such as current signals and speed signals.

The above-mentioned closed system related to the dirt collection device will be further explained in the follow-up. In order to detect the degree of dirt in the dirt collection device 40, a dirt detection method for cleaning device is provided. The dirt detection method comprises the steps of:

S100: Choose a motor 10 with a motor processor 20, and the motor in this preferred embodiment is a brushless motor as an example;

S200: Enable the brushless motor 10 provide power to form negative pressure and use the negative pressure to suck dirt into a dirt collection device 40.

S300: Write a threshold range for detection into a detection processor, and then connect the motor processor 20 to the detection processor so that the motor processor 20 sends the operating signal of the brushless motor 10 to the detection processor.

S400: The detection processor compares the threshold range with the operating signal from the motor processor.

Preferably, in step S400, according to the comparison result, the detection processor sends out a control signal.

Preferably, in step S400, when the operating signal enters the threshold range, the detection processor recognizes that the dirt collection device 40 is in a full state, and sends a corresponding control signal; or when the operating signal does not enter the threshold range, the detection processor recognizes that the dirt collection device is not yet full, and sends a corresponding control signal.

Preferably, the operating signal is a current signal, and the threshold range is a current value range.

Preferably, the operating signal is a speed signal, and the threshold range is a speed range.

Preferably, the motor is a brushless motor, and the brushless motor has an electronic speed controller, and the motor processor is a processor provided on the electronic speed controller.

It should be noted that the above-mentioned motor processor is the processor used to obtain and process the motor running signal. Through the peripheral circuit, the analog signal in the motor running change can be converted into a digital signal for signal processing.

In the specific implementation process, the detection processor used for signal comparison is set on a PC board, which is the main control processing of the PC board. At the same time, the detection processor can also send a control signal for the entire cleaning device. For example, when the dirt is detected, it sends a stop signal. After the dirt is processed, it sends a signal to restart.

In specific implementation, for example, the detection processor of the PC board sets the current value range for detection to 0.1 A-0.8 A 歐 The dirt in the dirt collection device 40 is collected and affects the air pressure of the negative pressure system, and when it has a reverse effect on the motor 10, the current value of the motor 10 enters 0.1 A, which is considered to be in a full state, and the detection processor immediately make corresponding feedback. Similarly, when the speed value range used for detection is 1000 r/min, when the detected speed drops to 1000 r/min, it is considered to be in a full state, and the detection processor also makes corresponding feedback. It should be noted that the above threshold range of 0.1 A-0.8 A and 1000 r/min are examples to illustrate the principle process. The actual design and use of the product are based on the specific device model and applicable environment.

It should be noted that in the specific implementation process, if the motor is changed to a brushed motor, it will have different operating signals. When using a brushed motor, the main reason is that the air pressure changes, and the motor's set output power remains unchanged, the reverse action of the air pressure will affect the actual output power of the brushed motor, which in turn affects the current for judgment. Based on the same air pressure-power change, when using a brushless motor, it can be judged by obtaining the current and speed.

Figure 4:
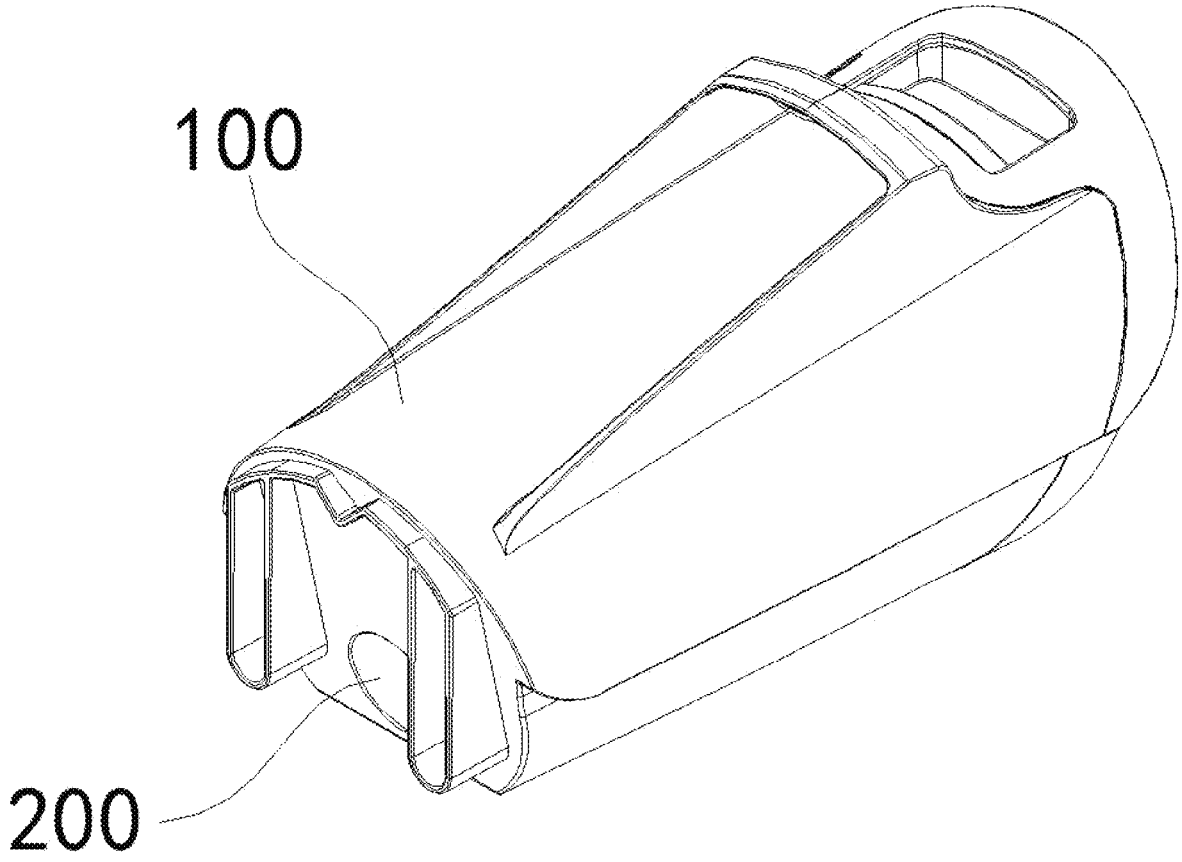
FIG. 4 is an oblique top elevational view of a dirt collection device provided by an embodiment of the present invention.
Figure 5:
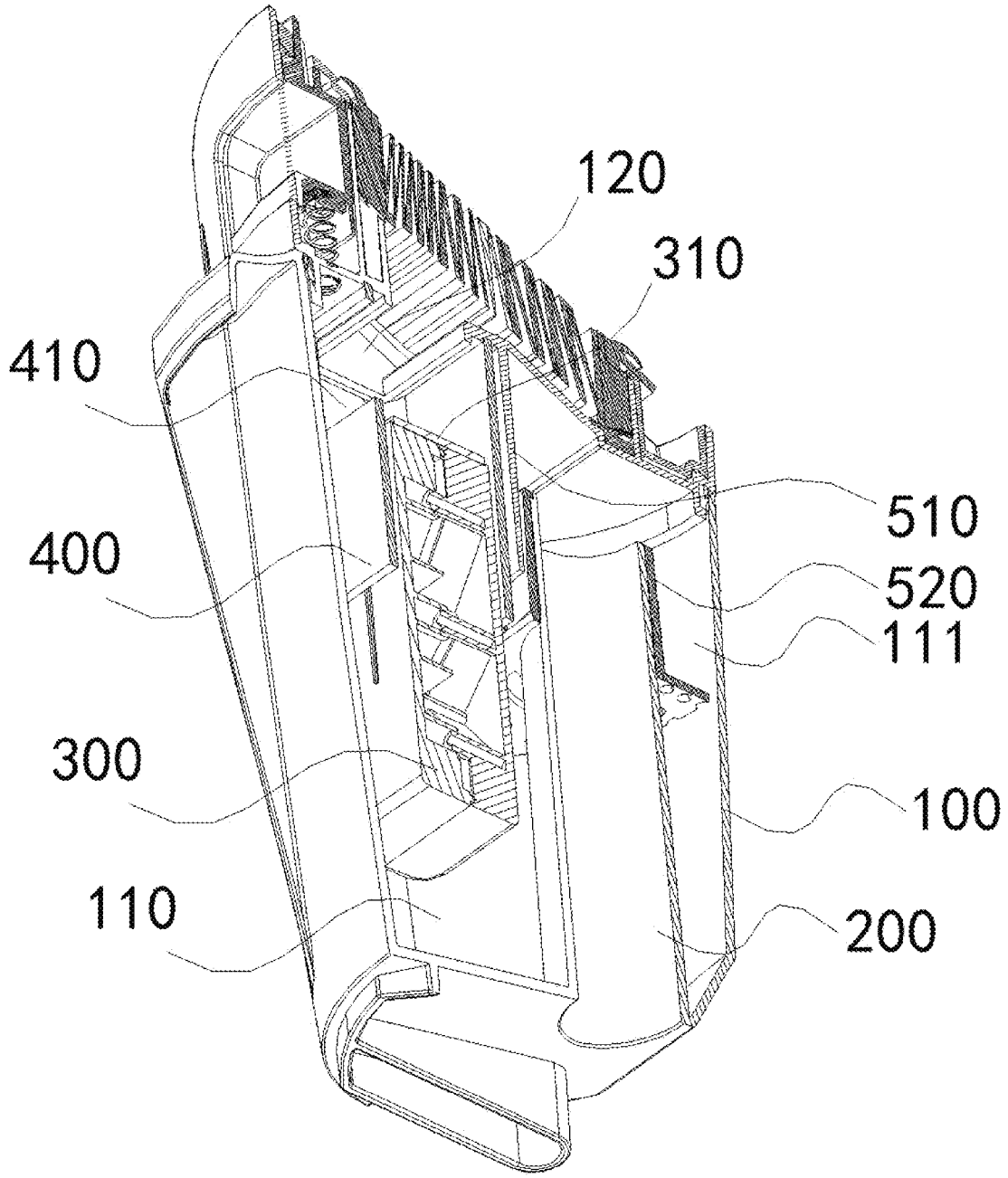
FIG. 5 is a sectional elevational view of the dirt collection device of the present invention.
Figure 6:
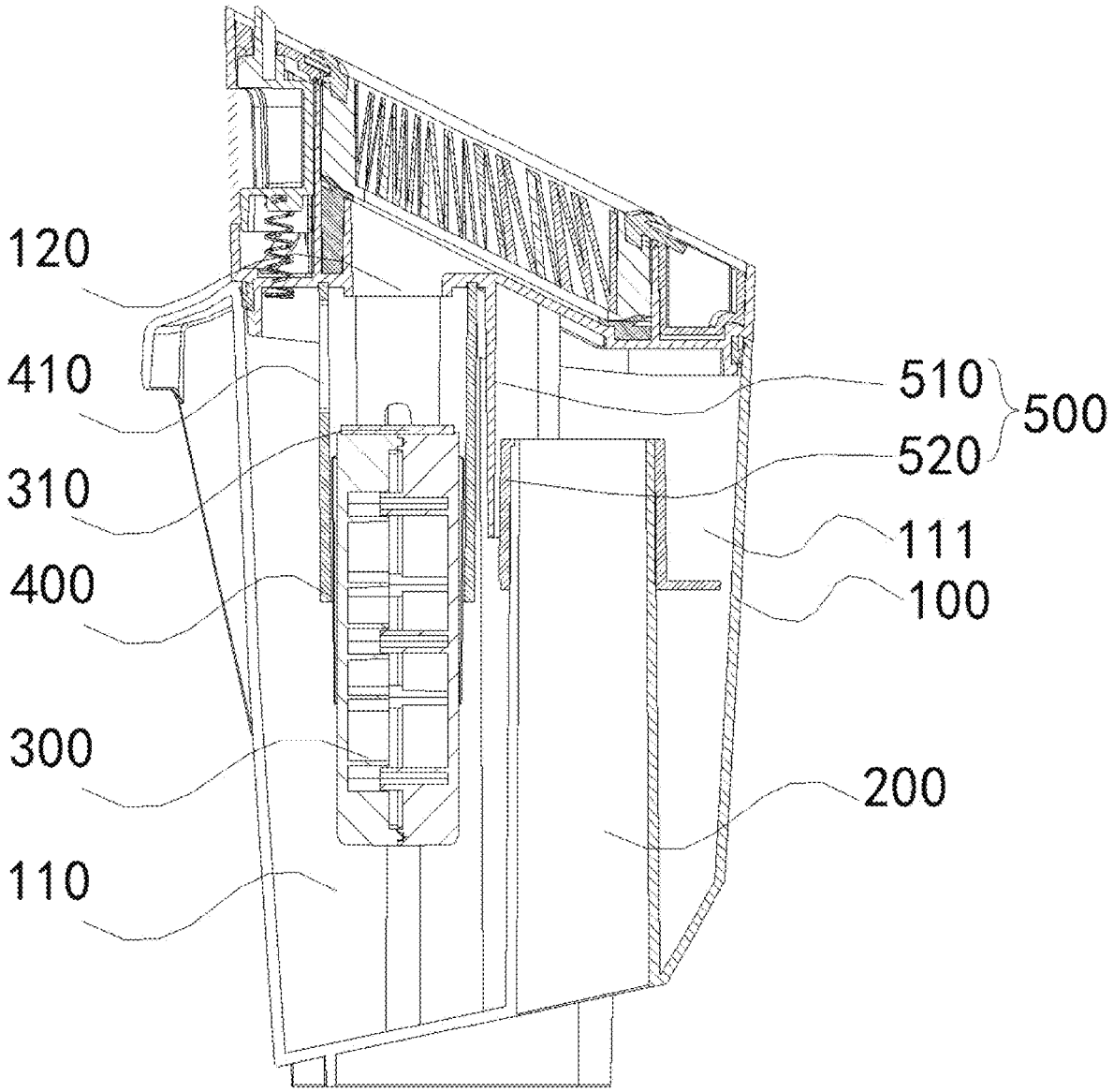
FIG. 6 is another sectional elevational view of the dirt collection device of the present invention.

In order to realize the dirt collection device of the above-mentioned dirt detection method, please refer to FIGS. 4-6, which mainly comprises a chassis 100. A chamber 110 is formed in the chassis 100 for dust collection. A feed pipe 200 is provided in the chamber 110, and the feed pipe 200 is connected to the chamber 110 and the outside. A trigger 300 is slidably arranged in the chamber 110, the lower end of the trigger 300 is suspended and faces the lower part of the chamber 110, and the upper end of the trigger 300 is slidably connected to a support member 400. A cavity 120 is formed on the chassis 100, and the cavity 120 is opposite to the upper end of the trigger 300, so that the upper end of the trigger 300 closes the cavity 120 after sliding.

As a part of the entire cleaning device, the chassis 100 is used to directly form the chamber 110 to save raw materials and reduce the difficulty of assembly. The chamber 110 is used to collect the dirt absorbed by the aforementioned negative pressure system, specifically through the feed pipe 200 into the chamber 110. When the dirt in the chamber 110 accumulates to a certain extent, the trigger 300 is pushed to slide. After the trigger 300 slides, it closes the cavity 120 through its upper end, thus forming a completely closed state in the chamber 110 (the feed pipe 200 and the chassis 100 are sealed and connected), so that the air pressure in the chamber 110 will react through the feed pipe 200. In addition, in specific implementation, this solution combines the applicable overall cleaning device, after the trigger 300 closes the cavity 120, through the air pressure reaction state in the chamber 110, the entire cleaning device can also be controlled. In this way, it can be used as a specific form of transmission control.

In specific implementation, preferably, the feed pipe 200 extends upward from the lower end of the chamber 110 into the chamber 110, and the feed pipe 200 and the chassis 100 are integrally formed. With this structure, it is convenient for the outer circumference of the feed pipe 200 to form a sealed airtight connection with the chassis 100.

In specific implementation, preferably, it also comprises a partition 500, which together with the chassis 100 forms a closed cabin 111 inside the chamber 110. The upper end of the feed pipe 200 extends into the closed cabin 111, and a through hole is formed on the partition 500 to connect the interior of the closed cabin 111 and the interior of the chamber 110. Through the arrangement that the closed cabin 111 is formed by partition 500 and the through hole is formed on the partition 500, it can filter larger solid dirt.

In specific implementation, preferably, the partition 500 comprises a first partition part 510 integrally formed with the chassis 100 and a second partition part 520 close to, in contact with, or not in contact with the first partition part 510. The feed pipe 200 passes through the second partition part 520 and extends into the closed cabin 111, and the through hole is set on the second partition part 520. The partition 500 is divided into two parts, which is convenient for installation by assembly during use. The first partition part 510 and the chassis 100 are integrally formed to facilitate the formation of a sealed connection. The second partition part 520 is close to the first partition part 510, and forms a gap with a suitable width in a non-contact state, which facilitates blocking of larger-sized dirt and allows liquid to pass through. If the second partition part 520 and the first partition part 510 are not in contact and are not close, the gap between the two is too large, and the larger-sized dirt will pass through, and the filtering effect cannot be achieved. The second partition part 520 and the first partition part 510 can also be in contact to form a relatively closed connection, and the liquid passes through the through hole on the second partition part 520.

In specific implementation, preferably, the support member 400 is a tubular plate, and the trigger 300 is a straight plate-shaped member, and is vertically slidingly fitted with the inner wall of the support member 400. In this optimization, the structure of the support member 400 and the trigger 300 are specifically given, and they are stable in use.

In specific implementation, preferably, the side wall of the support member 400 is provided with a window 410. By setting the window 410 to connect, it is convenient to balance the pressure on both sides.

In specific implementation, preferably, the upper end of the trigger 300 is provided with a panel 310 whose outer peripheral edge is adapted to the shape and size of the inner wall of the cavity 120. The cavity 120 is sealed by setting the panel 310 to ensure the effect of sealing.

The preferred embodiment of the present invention has been described in detail above. It should be understood that those of ordinary skill in the art can make many modifications and changes according to the concept of the present invention without creative work. Therefore, all technical solutions that can be obtained by those skilled in the art through logical analysis, reasoning or limited experiments based on the concept of the present invention on the basis of the prior art should fall within the scope of protection determined by the claims.

What is claimed is:

1. A dirt collection device comprising:

a chassis, said chassis having a chamber formed therein for dust collection;

a feed pipe provided in said chamber, said feed pipe connecting said chamber with the external;

a support member set in said chamber;

a trigger (300) slidably set in said chamber, said trigger having a lower end thereof suspended and facing said chamber and an opposing upper end thereof slidably connected to said support member; and a cavity formed on said chassis, said cavity being set opposite to said upper end of said trigger, so that said upper end of said trigger closes said cavity after sliding, wherein said feed pipe extends upward from a lower end of said chamber into said chamber; said feed pipe and said chassis are integrally formed, and wherein the dirt collection device further comprises a partition, which together with said chassis forms a closed cabin inside said chamber, wherein said feed pipe has an upper end thereof extended into the closed cabin; said partition has a through hole formed thereon to connect the interior of said closed cabin and the interior of said chamber.

2. The dirt collection device as claimed in claim 1, wherein said partition comprises a first partition part formed integral with said chassis, and a second partition part; said feed pipe extends through said second partition part into said closed cabin; said through hole of said partition is formed on said second partition part.

3. The dirt collection device as claimed in claim 1, wherein said support member is a tubular plate; said trigger is a straight plate-shaped member and is vertically slidingly fitted with said inner wall of said support member.

4. The dirt collection device as claimed in claim 3, wherein said support member comprises a window formed on one side wall thereof.

5. The dirt collection device as claimed in claim 4, wherein said trigger has an upper end thereof provided with a panel, said panel having an outer peripheral edge thereof adapted to the shape and size of an inner wall of said cavity.

* * * * *